US005353537A

United States Patent [19]

Mercenier

[11] Patent Number: 5,353,537

[45] Date of Patent: Oct. 11, 1994

[54] FIRE ARM WITH MOBILE LOADER AND LOADER FOR SUCH AN ARM

[75] Inventor: Marc Mercenier, Ans, Belgium

[73] Assignee: Browning, societe anonyme, Herstal, Belgium

[21] Appl. No.: 132,898

[22] Filed: Oct. 7, 1993

[30] Foreign Application Priority Data

Oct. 7, 1992 [BE] Belgium ..... 09200872

[51] Int. Cl.[5] ..... F41A 9/25

[52] U.S. Cl. ..... 42/7; 42/50

[58] Field of Search ..... 42/7, 50, 49.01, 18, 42/22; 89/195, 196, 197, 34, 33.1

[56] References Cited

U.S. PATENT DOCUMENTS

| | | | |
|---|---|---|---|
| 1,176,254 | 3/1916 | Smith | 42/7 |
| 1,866,202 | 7/1932 | Floyd | 42/22 |
| 3,143,820 | 8/1964 | Lucianetti et al. | 42/50 |
| 4,579,037 | 4/1986 | Gillum | 89/196 |
| 4,664,015 | 5/1987 | Kennedy | 89/138 |

FOREIGN PATENT DOCUMENTS

| | | | |
|---|---|---|---|
| 670534 | 2/1966 | Belgium . | |
| 300674 | 4/1920 | Fed. Rep. of Germany | 42/50 |
| 395742 | 5/1921 | Fed. Rep. of Germany | 89/196 |
| 513176 | 11/1930 | Fed. Rep. of Germany | 42/18 |
| 1427923 | 1/1966 | France . | |

*Primary Examiner*—Stephen M. Johnson
*Attorney, Agent, or Firm*—Bacon & Thomas

[57] ABSTRACT

A fire arm includes a casing, a barrel mounted on a recoil slide which slides over this casing, a loading and trigger mechanism and a loader including a case closed at one end by a bottom, a mobile feeder inside the case and a feeder spring (13) between the feeder and the bottom. The fire arm has a grip, a cavity for the loader extending through the grip from a charging opening to the inside of the fire arm. A loader stop is mounted on the casing in order to keep the loader inside the cavity. In addition, the fire arm includes an ejection spring situated at the height of the charging opening of the cavity, at least partly on the outside of the case, such that the ejection spring is stretched when the loader is inserted right to the bottom of the cavity so as to aid in ejecting the loader from the cavity, independent of the number of cartridges in the loader.

6 Claims, 2 Drawing Sheets

Fig. 4
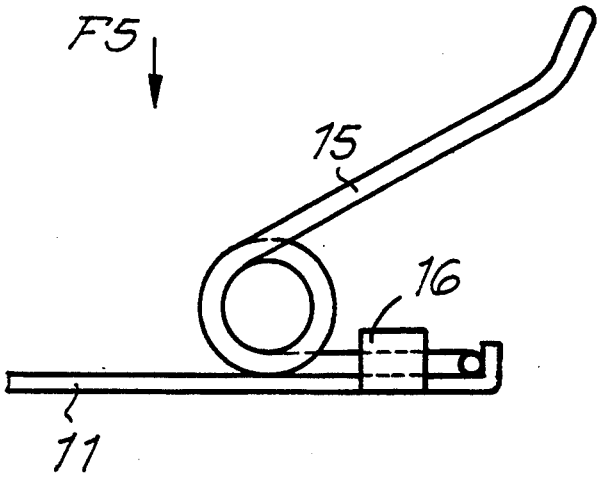
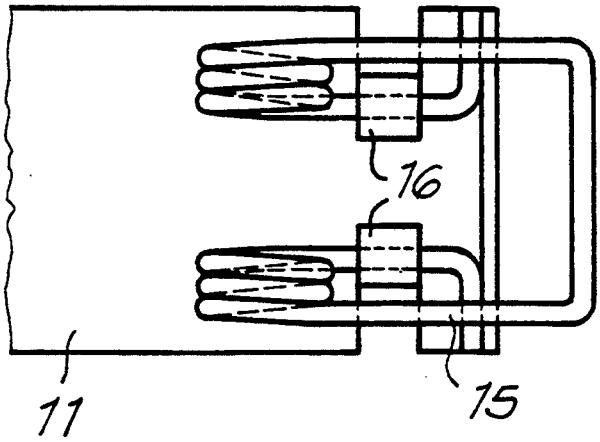
Fig. 5

FIRE ARM WITH MOBILE LOADER AND LOADER FOR SUCH AN ARM

BACKGROUND OF THE INVENTION

The invention pertains to a fire arm having a mobile loader in the grip. The fire arm includes a casing, a barrel mounted in a recoil slide which slides over this casing, a loading and trigger mechanism and a loader including a case closed at one end by a bottom, a mobile feeder inside the case and a feeder spring between the feeder and the bottom. The fire arm also has a grip with a cavity for the loader extending through this grip from a charging opening to the inside of the fire arm. In addition, a loader stop is mounted on the casing in order to keep the loader inside the cavity.

With this type of fire arms, in particular semi-automatic or automatic pistols, the loader stop contains a part which forms a button protruding on the outside of the grip, whereby the ejection of the loader is manually operated by pressing this button. As a result, the loader is separated from the rest of the fire arm. The ejection thus takes place as the pressure of the loader spring acts on the slide stop with the help of the feeder when the feeder is open (in other words not locked). In the case where the loader is provided with cartridges, it will be the pressure of the spring acting on the cartridges striking against the lower part of the slide which disengages the loader (locked slide). In the case where the slide is locked and the loader is empty, it will be the feeder which acts on the slide stop.

Although this ejection arrangement is very powerful, it strongly varies depending on the number of cartridges in the loader as the spring is more compressed as there are more cartridges. When the loader is empty, the feeder is directly connected to the slide stop. When the last cartridge is ejected, the slide unlocks the barrel as it recoils and recocks the hammer. The slide is kept in the stop position by the slide stop which is maintained in the lock notch of the slide due to the action of the loader spring, with the aid of the feeder. When, due the pressure of the spring, the loader is separated from the fire arm, the latter disengages itself over a very short distance, namely 5 to 10 min.

SUMMARY OF THE INVENTION

The invention aims to remedy this disadvantage and to provide a fire arm with a mobile loader in which the ejection of the loader is relatively powerful and practically independent of the number of cartridges which are still available in the loader.

According to the invention, this aim is achieved by situating an ejection spring at the bottom of the loader such that the ejection spring is compressed as the loader is inserted in the casing. The spring is maximally compressed as the loader is locked by means of the loader stop. As soon as the loader is set free by pressing the button of the loader stop, the spring is released and provides a powerful ejection of the loader.

According to a preferred embodiment of the invention, the ejection spring is mounted on the loader and works in conjunction with part of the grip. The ejection spring is preferably a tread spring mounted at the bottom of the loader that protrudes laterally from the case. The thread spring is preferably fixed by a breech bolt at the bottom of the loader. Part of the spring protrudes in relation to the case through an opening in the latter.

The invention also concerns a loader for fire arms with the loader including an ejection spring situated at least partly on the outside of the case near the bottom.

BRIEF DESCRIPTION OF THE DRAWINGS

In order to better explain the characteristics according to the invention, an example of an embodiment of a fire arm with a mobile loader and a loader for such a fire arm according to the invention are described below, by way of example only and without being limitative in any way, with reference to the accompanying drawings, where:

FIG. 4 represents the part indicated by F4 in FIG. 2 to a larger scale;

FIG. 5 is a view according to arrow F5 in FIG. 4 of part of the bottom of the loader.

DETAILED DESCRIPTION OF THE PREFERRED EMBODIMENT

Figure 1:
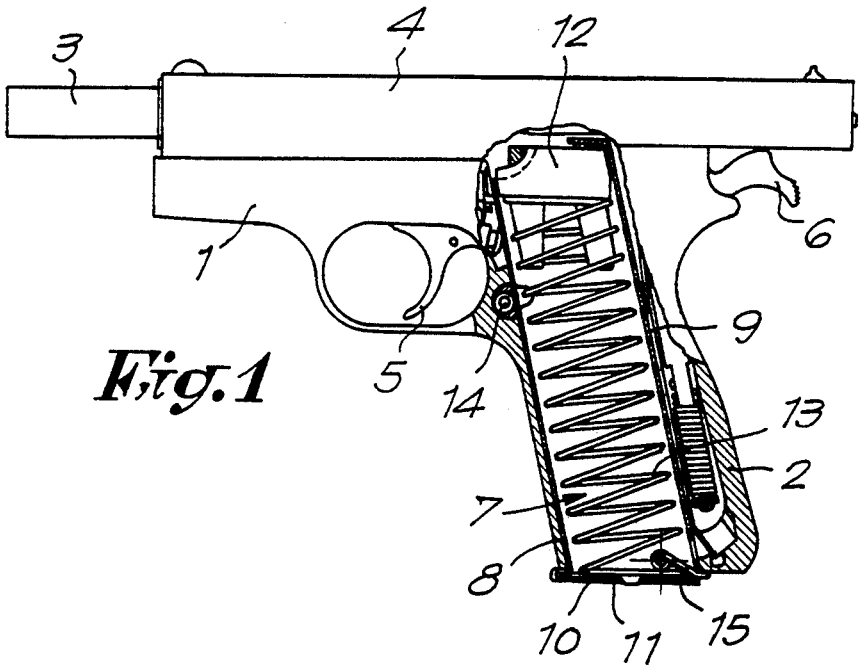
FIG. 1 is a lateral view with a partial cross-section of a fire arm according to the invention.

The fire arm represented in FIG. 1 is a semi-automatic pistol which mainly consists of a casing 1, part of which mainly forms the grip 2 of the fire arm, a barrel 3 mounted in a mobile slide 4 that slides over the casing 1, a loading and trigger mechanism including a trigger 5 and a hammer 6, and a loader 7 adapted to be inserted inside a cavity 8 in the grip 2 and extending from the opening at the far end of the grip to the internal part of the fire arm, namely to the percussion chamber for the cartridges.

The loading and trigger mechanism, which is mounted inside and on the casing 1, has a design which is known to the expert, and therefore is not described in detail.

Figure 2:
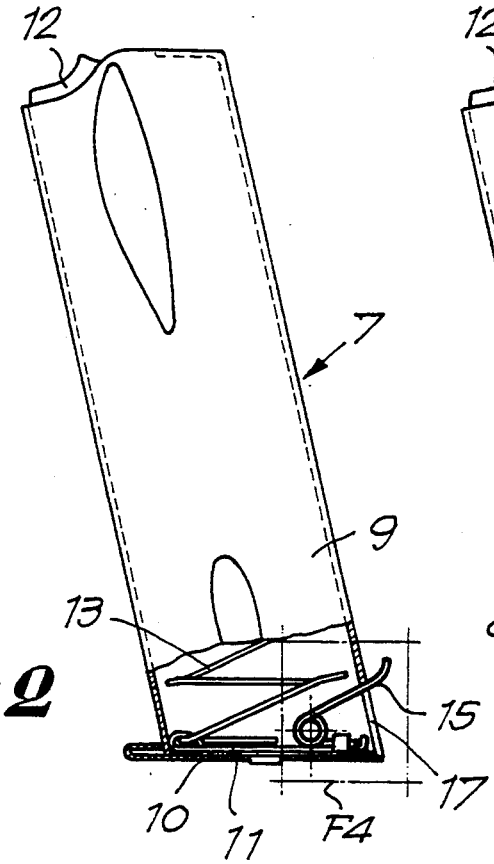
FIG. 2 is a lateral view with a partial cross-section of the loader of the fire arm in FIG. 1, to a larger scale, whereby the ejection spring is represented in the non-loaded position.
Figure 3:
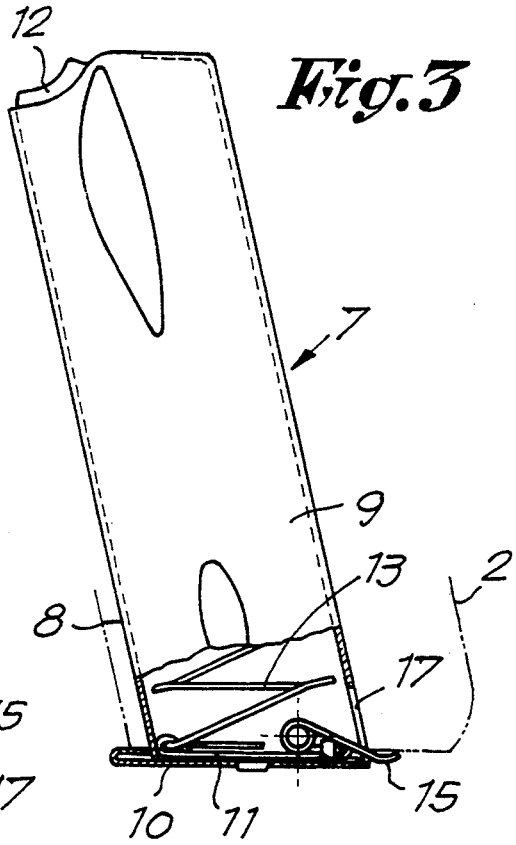
FIG. 3 is a view analogous to that in FIG. 2, but with the ejection spring in the loaded position.

The loader 7, represented in detail in FIGS. 2 and 3, contains a case 9, a bottom 10 closing off one end of the case 9 and held in place on the case 9 by means of a bottom plate 11, a mobile feeder 12 inside the case 9 and a feeder spring 13 mounted between the feeder 12 and the bottom 10.

A loader stop 14 is mounted on the casing 1, at the height of the trigger 5, in order to keep the loader 7 in place. This loader stop 14 has an end which forms a button protruding on the outside of the casing 1. Loader stop 14 works in conjunction with a spring (not shown)in a manner known in the art.

The invention is particularly directed to an ejection spring 15 mounted at the bottom 10 and, more particularly, on the bottom plate 11. The ejection spring 15 is preferably a thread spring. As represented in detail in FIGS. 4 and 5, spring 15 is U-shaped and the end of each branch is curled up into a spiral and ends in a part which, when the spring is in its rest position, forms an angle with the rest of the branch. This end part is fixed against the bottom plate 11 by means of two folded tongues 16 which form one piece with plate 11.

As represented in FIGS. 2 and 3, the ejection spring 15 has one end that extends through an opening 17 in the wall of the case 9 immediately near the bottom 10.

As the loader 7 is inserted in the cavity 8, the end of the ejection spring 15 extends outside the case 9, the end being in the position as represented in FIG. 2, and makes contact with the end of the grip 2, whereby the spring is stretched. As the loader 7 is inserted right to the bottom, the loader stop 14 automatically locks loader 7 in the cavity 8 and the ejection spring 15 is then completely stretched and is in the loaded position as represented in FIGS. 1 and 3.

In order to remove the loader 7, one only has to push the button of the loader stop 14. As a result, the stop 14 assumes the release position and the loader 7 is separated from the casing 1. The loader 7 is then ejected from the cavity 8, mainly due to the action of the ejection spring 15.

Due to the presence of the ejection spring, this ejection arrangement is very powerful, whereby this power is especially independent of the number of cartridges in the loader.

Naturally, many modifications can be made to the above-described example while still remaining within the scope of the invention as described in the following claims.

I claim:

1. A fire arm comprising:

a casing;

a recoil slide slidably mounted about said casing;

a barrel positioned within said recoil slide;

a trigger mechanism carried by said casing;

a loader including a case closed at one end by a bottom, a mobile feeder inside said case and a feeder spring between said feeder and the bottom;

a grip formed with said casing, said grip defining a cavity for receiving the loader which extends from an opening of said cavity to inside of the fire arm;

a loader stop mounted on the casing; and an ejection spring carried by said loader, said electron spring being situated at the opening of the cavity, projecting at least partly outside of the case and engaging said grip when the loader is fully inserted in said cavity, wherein said ejection spring is stretched when the loader is inserted within the cavity so as to provide a preload for ejection of the loader from the cavity.

2. The fire arm according to claim 1 wherein the ejection spring is mounted on a bottom plate of the loader.

3. The fire arm according to claim 2 wherein the ejection spring laterally protrudes from the case.

4. The fire arm according to claim 3 wherein the ejection spring is mounted inside the loader on the bottom plate and part of said spring protrudes through an opening formed in said case.

5. A loader for use in retaining cartridges in a fire arm comprising:

a case having a first, open end and a second end closed by a bottom, said case including an opening formed therein between said first and second ends and directly adjacent said bottom;

a mobile feeder positioned inside said case;

a feeder spring located within said case between said feeder and said bottom to bias said feeder toward said first, open end; and an ejection spring having a first portion mounted within said casing and a second portion laterally protruding from said case through said opening.

6. A loader according to claim 5, wherein the bottom of said case is closed by a plate and the first portion of said ejection spring is mounted to said plate.

* * * * *